US006955027B2

(12) United States Patent
Suolahti

(10) Patent No.: US 6,955,027 B2
(45) Date of Patent: Oct. 18, 2005

(54) CRINKLING DEVICE

(75) Inventor: Yrjo Suolahti, Mynämäki (FI)

(73) Assignee: Oy M. Haloila AB, Masku (FI)

( * ) Notice: Subject to any disclaimer, the term of this patent is extended or adjusted under 35 U.S.C. 154(b) by 0 days.

(21) Appl. No.: 10/804,189

(22) Filed: Mar. 19, 2004

(65) Prior Publication Data

US 2004/0244336 A1 Dec. 9, 2004

(30) Foreign Application Priority Data

Mar. 21, 2003 (FI) ..... 20030421

(51) Int. Cl.[7] ..... B65B 61/00

(52) U.S. Cl. ..... 53/141; 53/588; 53/587; 53/389.2

(58) Field of Search ..... 53/141, 389.2, 53/389.3, 587, 588, 556; 242/271, 548.2, 615.3

(56) References Cited

U.S. PATENT DOCUMENTS

| | | | | |
|---|---|---|---|---|
| 4,255,918 A | * | 3/1981 | Lancaster et al. | 53/556 |
| 4,271,657 A | * | 6/1981 | Lancaster et al. | 53/587 |
| 4,336,679 A | | 6/1982 | Lancaster et al. | |
| 4,432,185 A | * | 2/1984 | Geisinger | 53/587 |
| 4,563,863 A | * | 1/1986 | Humphrey | 53/556 |
| 4,807,427 A | | 2/1989 | Casteel et al. | |
| 4,905,451 A | * | 3/1990 | Jaconelli et al. | 53/141 |
| 5,031,771 A | | 7/1991 | Lancaster | |
| 5,107,657 A | | 4/1992 | Diehl et al. | |
| 5,203,136 A | * | 4/1993 | Thimon et al. | 53/141 |

FOREIGN PATENT DOCUMENTS

| | | |
|---|---|---|
| CA | 2287675 | 4/2001 |
| EP | 0 511 870 A1 | 11/1992 |

* cited by examiner

*Primary Examiner*—John Sipos
(74) *Attorney, Agent, or Firm*—Lowe Hauptman & Berner, LLP

(57) ABSTRACT

The invention relates to a crinkling device comprising a slide rod (16), to which a second crinkling element (15) is fastened. The slide rod is guided in a frame (2) so as to be movable in a substantially vertical direction between a lower position (L), in which the second crinkling element (15) is out of contact with the lower edge (4) of a foil web (1), and an upper position (U), in which the second crinkling element (15) deflects the lower edge (4) of the foil web (1) upwards so as to crinkle it. The slide rod returns to the lower position (L) when not exposed to a force acting in the upward direction. The device further comprises first coupling means ($17^1$, $18^1$) for forming a releasable coupling between the slide rod (16) and a first drive element portion (8) when the drive element (7) is running in a first direction (11) to move the second crinkling element (15) to the upper position (U). Second coupling means ($17^2$, $18^2$) are provided to form a releasable coupling between the slide rod (16) and a second drive element portion (9) when the drive element (7) is running in a second direction (12) to move the second crinkling element (15) to the upper position (U). By driving the drive element (7) in the first running direction (11), the foil web (1) can only be crinkled from its lower edge (4). By driving the drive element (7) in the second running direction (12), the foil web (1) can be crinkled optionally either from the upper edge (3) by a first crinkling element (14) without crinkling the lower edge (4) or from the upper edge (3) and the lower edge (4) simultaneously.

10 Claims, 4 Drawing Sheets

CRINKLING DEVICE

FIELD OF THE INVENTION

Figure 1:
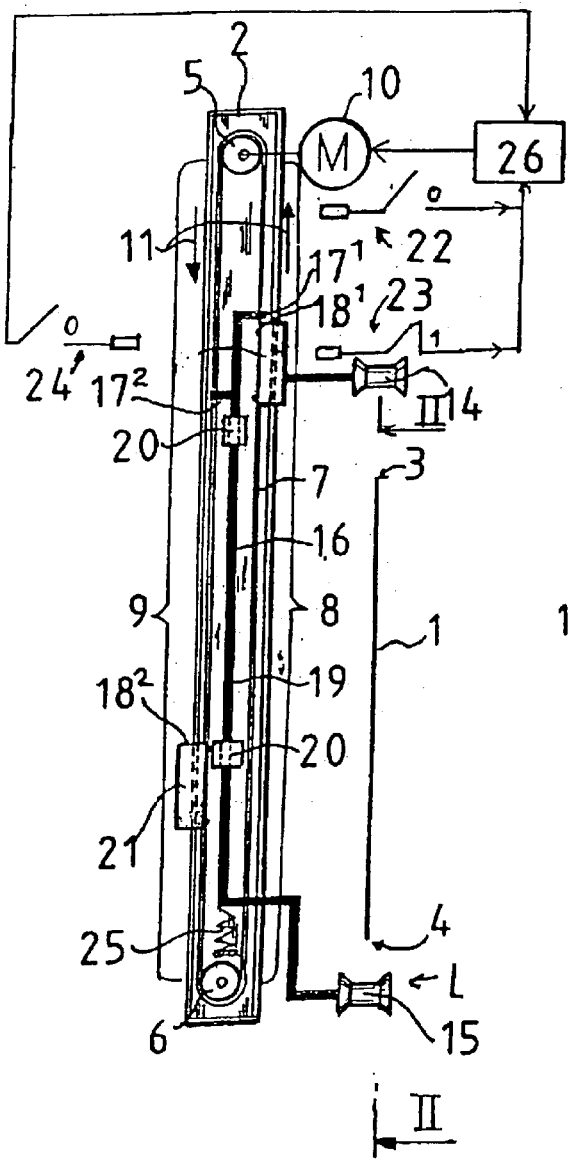

The present invention relates to a crinkling device as defined in the preamble of claim 1.

BACKGROUND OF THE INVENTION

In prior art, a crinkling device as disclosed in the preamble of specification EP 0 511 870 A1 for use with a wrapping machine to adjust the width of a film web to be wrapped around an object between a full web width and a narrowed, string-like web width is known.

The crinkling device comprises a frame secured to the film dispenser of the wrapping machine, said film dispenser carrying a film web roll of film web having a longitudinal upper edge and a longitudinal lower edge.

The crinkling device further comprises a first wheel rotatably mounted on the frame and a second wheel rotatably mounted on the frame at a distance from the first wheel.

An endless drive element is passed over the first wheel and the second wheel so that a first drive element portion and a second drive element portion are formed between the wheels, said portions extending adjacently and parallel to each other in the widthwise direction of the film web. Connected to the first drive element portion is a carriage guided in the frame so as to be movable in the widthwise direction of the film web.

A first crinkling element is fastened to the first carriage to crinkle the upper edge of the film web. The crinkling device further comprises a second carriage, which is also guided in the frame so as to be movable in the widthwise direction of the film web. A second crinkling element is mounted on the second carriage to crinkle the lower edge of the film web.

A power means, consisting of a pneumatic cylinder, is arranged to move the second carriage in the widthwise direction of the film web. Mounted on the same shaft with the upper first wheel is a third wheel of a smaller diameter. Near the lower second wheel is a fourth wheel rotatably mounted on the frame on a different shaft than the second wheel. An endless second drive element is passed over the third and fourth wheels. The second carriage is fastened to the second drive element. Because of the difference between the sizes of the first and second wheels, a transmission ratio is formed between the first drive element and the second drive element such that when the second carriage is moved by the pneumatic cylinder, this movement is transmitted with the aforesaid transmission ratio into a movement of the first carriage. When the wrapping film is to be crinkled, the first carriage (and the first crinkling element) moves downwards through a distance longer than the upwards movement of the second carriage (and the second crinkling element) past the level of the second carriage. Due to the above-described mechanical transmission, the movements of the first and second carriages take place simultaneously. The prior-art crinkling device has the advantage that it uses only one power means.

A problem with the crinkling device disclosed in the above-mentioned specification is that it always crinkles the film web from the upper and lower edges without allowing them to be crinkled separately and independently of each other. Moreover, the device has a complex construction as it comprises two drive elements and two pairs of sheaves. Therefore, the crinkling device also comprises a large number of maintenance objects and parts subject to wear and replacement. Due to the complex construction, the manufacturing costs of the crinkling device are high. A further problem is that the distance through which the first and second crinkling elements travel during the crinkling action can not be varied without replacing components, i.e. without changing-the transmission ratio between the running speeds of the first and second drive elements by replacing the third wheel with a wheel of a larger or smaller diameter.

Another prior-art crinkling device works on the drive screw/nut principle, using one power means to rotate the drive screw, which has been arranged to move a first drive nut connected to a first carriage with a first crinkling element attached to it and a second drive nut connected to a second carriage with a second crinkling element attached to it. When the drive screw is rotated, the two carriages and the respective crinkling elements move in opposite directions through equal distances, with the result that the film web is contracted into a string at about the middle of the device. The problem is that the travel of each crinkling device is always the same and it is not possible e.g. to produce a slighter crinkling at the lower edge of the film web and a greater crinkling at the upper edge so as to produce from the film web a string located near the level of the lower edge of the original full web width.

OBJECT OF THE INVENTION

The object of the present invention is to overcome the above-mentioned drawbacks.

A specific object of the invention is to disclose a crinkling device that makes it possible to optionally crinkle the lower edge and/or the upper edge of the film separately or simultaneously.

A further object of the invention is to disclose a crinkling device having a construction as simple as possible.

A further object of the invention is to disclose a crinkling device in which the distances traveled by the crinkling elements can be easily varied.

BRIEF DESCRIPTION OF THE INVENTION

The crinkling device of the invention is characterized by what is disclosed in claim 1.

According to the invention, the crinkling device comprises a frame connected to a foil dispenser comprised in a wrapping machine, said foil dispenser carrying a foil web roll of foil web having a longitudinal upper edge and a longitudinal lower edge; a first wheel rotatably mounted on the frame; a second wheel rotatably mounted on the frame at a distance from the first wheel; an endless drive element, which is passed over the first wheel and the second wheel so as to form a first drive element portion and a second drive element portion extending adjacently and parallel to each other between the wheels in the widthwise direction of the foil web; a power means for moving the drive element optionally in a first running direction with the first drive element portion moving upwards and the second drive element portion moving downwards, and in an opposite second running direction with the first drive element portion moving downwards and the second drive element portion moving upwards; a first carriage, which is fastened to the first drive element portion and guided in the frame so as to be movable in the widthwise direction of the foil web; a first crinkling element, which is mounted on the first carriage for crinkling the upper edge of the foil web; and a second crinkling element, which is movable by the action of the drive element in the widthwise direction of the foil web for crinkling the lower edge of the foil web.

According to the invention, the crinkling device comprises a slide rod, to which the second crinkling element is connected. The slide rod is guided in the frame so as to be movable in a substantially vertical direction between a lower position, in which the second crinkling element is out of contact with the lower edge of the foil web, and an upper position, in which the second crinkling element deflects the lower edge of the foil web upwards so as to crinkle it. The slide rod has been arranged to return towards the lower position when not exposed to a force acting in the upward direction. The crinkling device further comprises first coupling means for forming a releasable coupling between the slide rod and the first drive element portion when the drive element is running in the first direction to move the second crinkling element to the upper position. In addition, the crinkling device comprises second coupling means for forming a releasable coupling between the slide rod and the second drive element portion when the drive element is running in the second direction to move the second crinkling element to the upper position. By driving the drive element in the first running direction, the foil web can be crinkled only from its lower edge. By driving the drive element in the second running direction, the foil web can be crinkled optionally either from the upper edge without crinkling the lower edge or from the upper edge and the lower edge simultaneously. By driving the drive element in the second running direction, the foil web can be crinkled by the first crinkling element either from the upper edge only without crinkling of the lower edge or alternatively simultaneously with crinkling of the lower edge by the second crinkling element.

The essential discovery of the invention is that the crinkling elements need not necessarily always perform a crinkling movement simultaneously towards each other, but that they can instead be used to crinkle the foil web either separately from the lower edge or the upper edge if it is desirable to form a web somewhat narrower than the full width, or simultaneously from the upper edge and the lower edge to form a narrow string-like web. An additional advantage is that the crinkling device provides the same advantages as the prior-art crinkling device that uses only one power means, while having a simple construction, which means that its manufacturing and maintenance costs are low.

In an embodiment of the crinkling device, the first coupling means comprise a first dog, which is provided on the slide rod near the upper end, and a second dog, which is provided on the first carriage and fitted to come into contact with the first dog when the drive element is running in the first direction.

In an embodiment of the crinkling device, the crinkling device comprises a second carriage, which is fastened to the second drive element portion and guided in the frame so as to be movable in the width-wise direction of the foil web.

In an embodiment of the crinkling device, the second coupling means comprise a third dog, which is provided on the slide rod near the upper end, and a fourth dog, which is provided on the second carriage and fitted to come into contact with the third dog when the drive element is running in the second direction.

In an embodiment of the crinkling device, the slide rod comprises a straight rod part by which the slid rod is connected to the frame by means of guide elements placed between the first drive element portion and the second drive element portion.

In an embodiment of the crinkling device, the slide rod is so mounted in the frame that the slide rod can be returned to the lower position by the action of gravitation.

In an embodiment of the crinkling device, a return spring is provided between the slide rod and the frame for returning the slide rod to the lower position.

In an embodiment of the crinkling device, the power means is a motor arranged to drive the first wheel or the second wheel.

In an embodiment of the crinkling device, the crinkling device comprises detectors for detecting the position of the carriages and controlling the power means on that basis to stop the motion of the drive element and to change its running direction.

In an embodiment of the crinkling device, the detectors have been arranged to control the power means on the basis of the position of the first carriage and the second carriage.

In an embodiment of the crinkling device, the detectors are proximity sensors having a first state and a second state. The detectors have been fitted to change their state between the first and second states when the first carriage and/or the second carriage is within the detection distance of the detector.

LIST OF FIGURES

Figure 2:
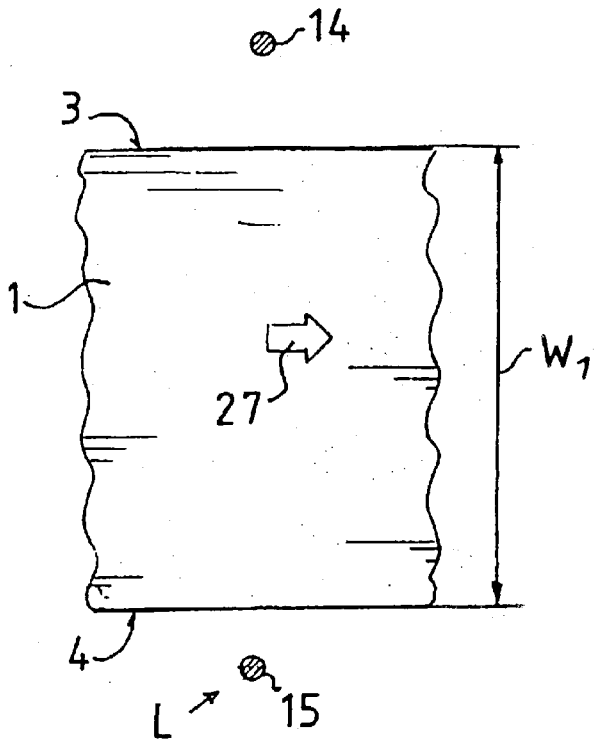
Figure 3:
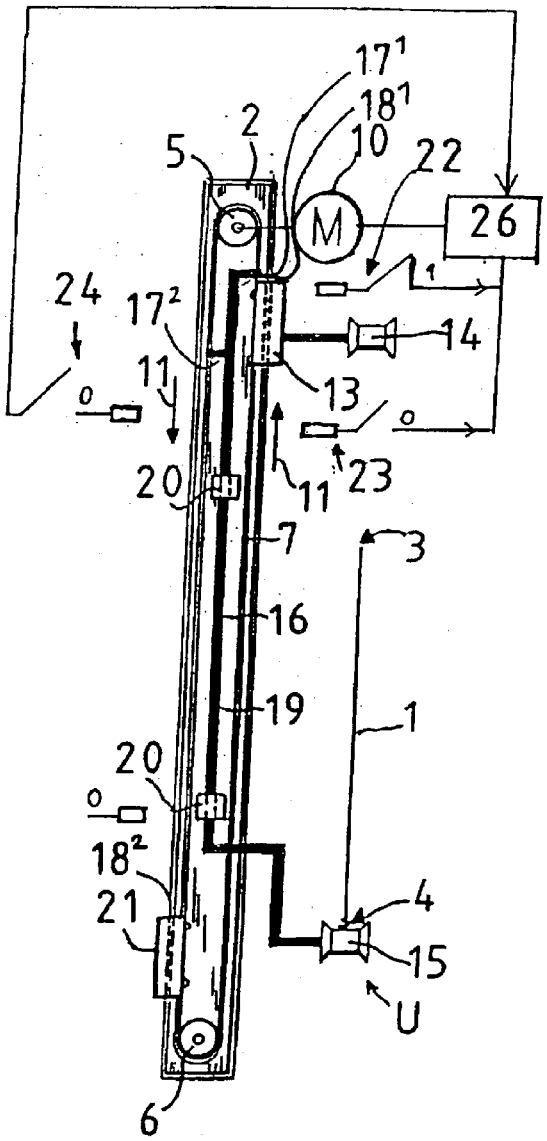
Figure 4:
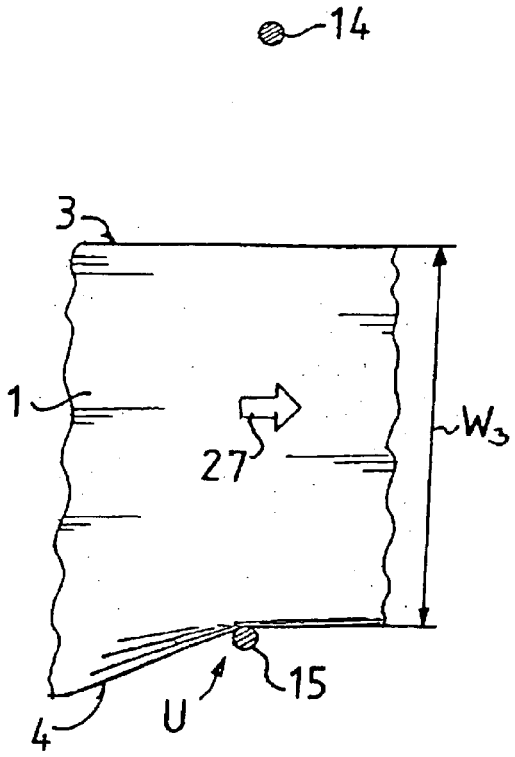
Figure 5:
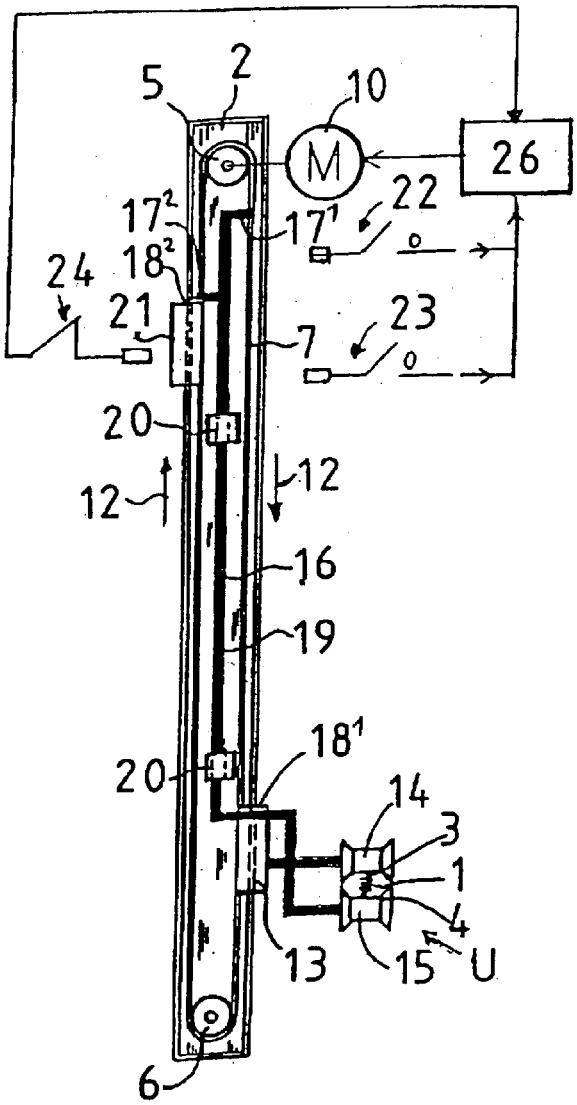
Figure 6:
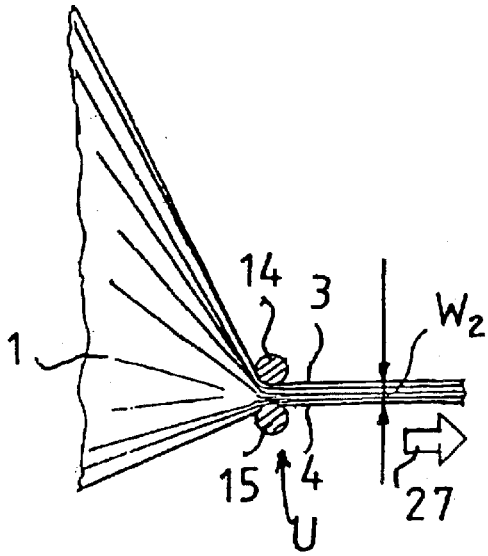
Figure 7:
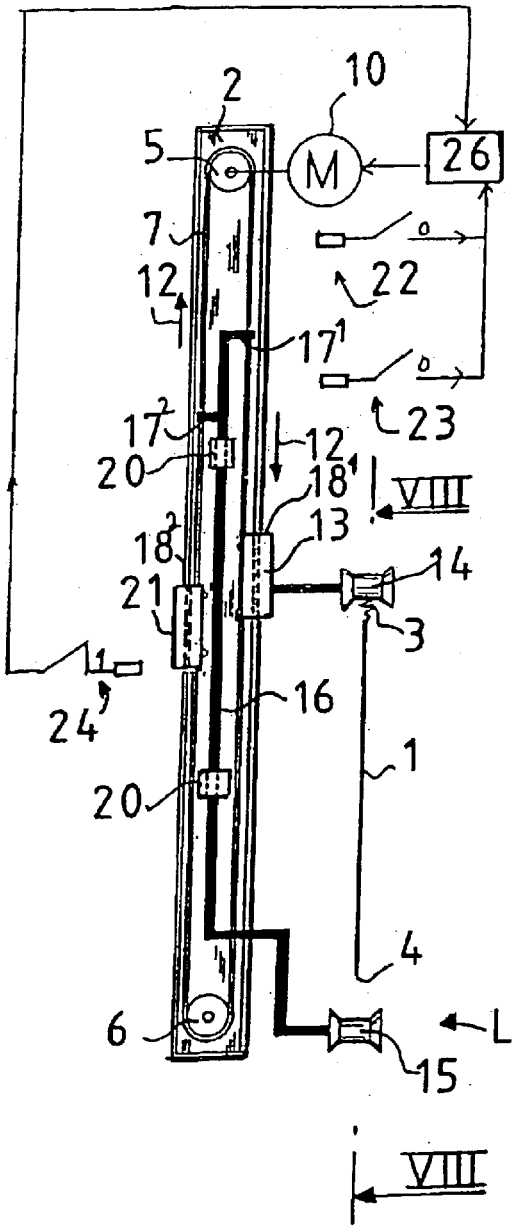
Figure 8:
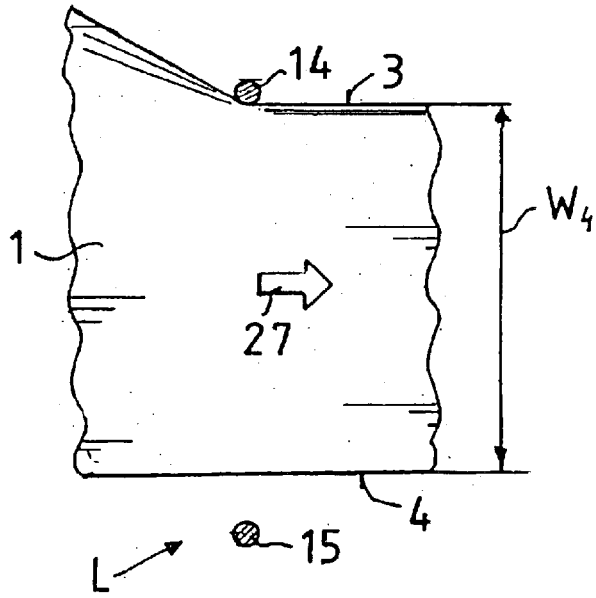

In the following, the invention will be described in detail on the basis of an example embodiment with reference to the attached drawings, wherein FIG. 1 presents an embodiment of the crinkling device of the invention in diagrammatic form, FIG. 2 presents the foil web and the crinkling elements in a sectional view along line II—II in FIG. 1, FIG. 3 presents the crinkling device of FIG. 1 at a first stage of a foil web crinkling process, FIG. 4, in a manner corresponding to FIG. 2, presents the foil web and crinkling elements at the stage illustrated by FIG. 3, FIG. 5 presents the crinkling device of FIGS. 1 and 3 at another stage, FIG. 6, in a manner corresponding to FIGS. 2 and 4, presents the foil web and crinkling elements at the stage illustrated by FIG. 5, FIG. 7 presents a second embodiment of the crinkling device of the invention in diagrammatic form, and FIG. 8 presents the foil web and crinkling device in a sectional view along line VIII—VIII in FIG. 7.

DETAILED DESCRIPTION OF THE INVENTION

FIGS. 1, 3 and 5 show a crinkling device for use with a wrapping machine, designed to adjust the width of a foil web 1 before the foil is passed around the object to be wrapped. The width of the foil web 1 is adjusted between a full web width $W_1$ (see FIGS. 1 and 2) and a web width $W_2$ (see FIGS. 5 and 6) reduced to a narrow string-like width. The crinkling device comprises an elongated narrow frame 2, which can be fastened to or is integrated with the foil dispenser (not shown) of the wrapping machine, the foil dispenser carrying a foil web roll of foil web 1 in the conventional manner. The operation and structure of the wrapping machine and foil dispenser are part of the expertise of the person skilled in the art, so they will not be described here in detail. For the operation of the crinkling device, it is essential that the foil should move in a substantially tense condition past it. In FIGS. 2, 4 and 6, the direction of motion of the foil, from left to right in the figures, is indicated by an arrow 27.

As shown in FIGS. 1 and 2, the foil web has a longitudinal upper edge 3 and a longitudinal lower edge 4, which-the crinkling device is designed to displace by optionally moving either only the upper edge separately downwards or only the lower edge upwards or simultaneously both the upper edge and the lower edge towards each other. To achieve these functions, the crinkling device comprises a first wheel 5 rotatably mounted on the frame 2. A second wheel 6 is rotatably mounted on the frame 2 at a distance from the first wheel 5 at a position below the latter. A flexible drive element 7 implemented as an endless loop, which may be a belt, chain, rope or the like, is passed over the first wheel 5 and the second wheel 6 so that a first drive element portion 8 and a second drive element portion 9 are formed between the wheels, said portions extending adjacently and parallel to each other in the widthwise direction of the foil web 1. The drive element 7 can naturally be formed as an endless loop from a plurality of parts connected to each other in succession. "Endless" means e.g. that even the carriages 13 and 21 to be described later on may form aforesaid parts of the endless drive element, the ends of the belt or the like being fastened to the carriage.

To move the drive element, the shaft of a motor 10 is coupled to rotate the first wheel 5 so as to move the drive element 7 optionally in a first running direction 11 and in a second running direction 12 reverse relative to the first direction. When the motor 10 is driving the drive element 7 in the first running direction 11, the first drive element portion 8 moves upwards while the second drive element portion 9 moves downwards. Correspondingly, when the motor 10 is driving the drive element 7 in the second running direction 12, the first drive element portion 8 moves downwards while the second drive element portion 9 moves upwards. Fastened to the first drive element portion 9 is a first carriage 13, which is guided in the frame 2 so as to be movable in the widthwise direction of the foil web 1. A first crinkling element 14 is connected to the first carriage 13 for crinkling the upper edge 3 of the foil web. A second carriage 21 is fastened to the second drive element portion 9 and guided in the frame 2 so as to be movable in parallel with the direction of motion of the first carriage 13, i.e. in the widthwise direction of the foil web 1.

A second crinkling element 15 for crinkling the lower edge 4 of the foil web 1 is connected to a slide rod 16, which is guided in the frame 2 so as to be movable in the widthwise direction of the foil web 1, i.e. in a substantially vertical direction. The slide rod 16 a straight rod part 19, which is connected to the frame 2 by guide elements 20 placed between the first drive element portion 8 and the second drive element portion 9. The slide bar 16 can move between a lower position L as shown in FIGS. 1 and 2 and an upper position U as shown in FIGS. 3–6. When no upward force is acting on the slide bar 16, it is automatically returned to the lower position L e.g. by gravity. This is possible because the bar portion 19 is fitted in the guide elements 20 with a loose sliding fit. To achieve a more reliable return movement, it is also possible to use a return spring 25 between the frame and the slide bar 16.

The crinkling device comprises first coupling means $\mathbf{17}^1$, $\mathbf{18}^1$ for forming a releasable coupling between the slide rod 16 and the first drive element portion 8 when the drive element 7 is running in the first direction 11 to move the second crinkling element 15 upwards so as to crinkle the lower edge of the foil web 1.

The coupling means $\mathbf{17}^1$, $\mathbf{18}^1$ consist of a first dog $\mathbf{17}^1$ provided on the slide bar 16 near its upper end and a second dog $\mathbf{18}^1$ provided on the first carriage 13. The first dog $\mathbf{17}^1$ is a first pin, which extends from the upper end of the slide bar 16 transversely across the path of movement of the first carriage 13, so that the upper surface of the first carriage 13 functions as a second dog $\mathbf{18}^1$ and meets the first pin $\mathbf{17}^1$ when the drive element 7 is running in the first direction 11.

The crinkling device further comprises second coupling means $\mathbf{17}^2$, $\mathbf{18}^2$ designed to form a releasable coupling between the slide rod 16 and the second drive element portion 9 when the drive element 7 is running in the second direction 12 (FIG. 5) to move the second crinkling element 15 to the upper position U. The crinkling device comprises a second carriage 21, which is fastened to the second drive element portion 9 and guided in the frame 2 so as to be movable in the widthwise direction of the foil web 1, i.e. in a vertical direction.

The second coupling means $\mathbf{17}^2$, $\mathbf{18}^2$ comprise a third dog $\mathbf{17}^2$, which is connected to the slide rod 16 near the upper end, and a fourth dog $\mathbf{18}^2$, which is connected to the second carriage 21 and fitted to come into contact with the third dog $\mathbf{17}^2$ when the drive element 7 is running in the second direction 12. The third dog is a second pin extending from the upper end of the slide bar 16 transversely across the path of movement of the second carriage 21, so that the upper surface of the second carriage 21 functions as a fourth dog $\mathbf{18}^2$ and meets the second pin $\mathbf{17}^2$ when the drive element 7 is running in the second direction 12.

With this arrangement, as illustrated in FIGS. 3 and 4, when the drive element 7 is driven in the first running direction 11, the foil web 1 is crinkled only from its lower edge 4 as the first carriage 13 pushes the slide bar 16 upwards before it, so that as the slide bar 16 rises to the upper position U, the second crinkling element 15 connected to it rises and crinkles the lower edge 4 of the foil web 1. At the same time, the first crinkling element 14 connected to the first carriage 13 rises upwards. The foil web 1, being narrowed from below, has a third web width $W_3$, which is narrower than the full web width $W_1$ but still wider than the second web width $W_2$ of the web reduced to a string-like form.

Correspondingly, according to FIGS. 7 and 8, when the drive element 7 is driven in the second running direction 12, the foil web 1 can be crinkled optionally from the upper edge 3 without crinkling the lower edge 4 by stopping the first carriage 13 at a position (as in FIG. 7) such that the second carriage 21 does not come into contact with the second pin $\mathbf{17}_2$ on the slide bar but remains at a distance from it. The second crinkling element 15 will now remain in the lower position L. The foil web 1 has a fourth web width $W_4$ narrowed from above, which is narrower than the full web width $W_1$ but still wider than the second web width $W_2$ of the web reduced to a string-like form.

Further optionally according to FIGS. 5 and 6, when the drive element 7 is driven in the second running direction 12, the foil web 1 can be crinkled from the upper edge 3 and from the lower edge 4 simultaneously. In this case, the drive element 7 is driven in the second running direction 12 until the upper surface $\mathbf{18}^2$ of the second carriage 21 meets the second pin $\mathbf{17}^2$ on the slide bar 16 and pushes the slide bar 16 upwards, so that, as the slide bar 16 is rising to the upper position U, the second crinkling element 15 connected to it rises, thus crinkling the lower edge 4 of the foil web 1. The first crinkling element 14 connected to the first carriage 13 comes downwards to a suitable predetermined distance relative to the second crinkling element 15, with the result that the foil web 1 passed between them is narrowed e.g. to the second web width $W_2$ reduced to a string-like form. It is obvious that, by using this device, it is possible to obtain any web widths between the full web width $W_1$ and the string-like web width $W_2$ by controlling the motor 10 so as to stop the carriages 13 and 21 at suitable positions, by controlling the running directions of the drive element 7 via selection of the direction of rotation of the motor 10 and/or by adjusting the vertical positions of the pins $17^1$, $17^2$ on the slide bar 16.

The functions of the device are preferably controlled by means-of detectors 22, 23, 24 to detect the current position of the carriages 13, 21 and, based on the positions detected, to control the power means 10 to stop the motion of the drive element 7 and change its running direction. The detectors 22, 23, 24 are proximity sensors having a first state 0 and a second state 1. The detectors 22, 23, 24 change their state between states 0 and 1 when the first carriage 13 and/or the second carriage 21 is/are within the detection distance of the detector. The first detector 22 and the second detector 23 have been arranged to observe the first carriage 13. The third detector 24 have been arranged to observe the second carriage 21. The detectors are connected to a control unit 26, which controls the operation of the motor 10 in accordance with the states 0 and 1 of the detectors.

In FIGS. 1 and 2, the crinkling device is in an initial situation where the foil web 1 is at its full web width $W_1$. The crinkling elements 14 and 15 are in an idle condition at a distance from the upper edge 3 and lower edge 4 of the foil web 1. The first detector 22 at the upper end of the crinkling device is the 0 state, the second detector 23 below it is the 1 state and the third detector 24 at the lower end is in the 0 state.

When a transition is to be made from the situation of FIG. 1 to the situation of FIG. 3 to crinkle only the lower edge 4 of the foil web 1, the control unit 26 issues a start command to the motor 10, whereupon the motor 10 starts moving the drive element 7 in the first running direction 11, as illustrated in FIGS. 3 and 4. As a result of the first carriage 13 moving away from the vicinity of the second detector 23, the latter assumes the 0 state. The second dog $18^1$ or upper surface $18^1$ of the first carriage 13 fastened to the first drive element portion 8 of the drive element 7 meets the first dog $17^1$ or pin $17^1$ of the slide bar 16 and pushes the slide bar 16 upwards, with the result that the second crinkling element 15 at the lower end of the slide bar 16 rises from the lower position L in FIG. 1 to the upper position U in FIG. 3, thus crinkling the lower edge 4 of the foil web 1. When the first carriage 12 enters the sensing area of the first detector 22, the first detector 22 assumes the 1 state, on the basis of which the control unit 26 stops the motor 10, When a transition is to be made from the situation of FIG. 1 to the situation of FIGS. 5 and 6 to crinkle the upper edge 3 and the lower edge 4 of the foil web 1 so as to produce a narrow second web width $W_2$, the control unit 26 issues a start command to the motor 10, whereupon the motor 10 starts driving the drive element 7 in the second running direction 12, as illustrated in FIGS. 5 and 6. First, the first carriage 13 connected to the first drive element portion 8 and the first crinkling element 14 attached to it move downwards, thus crinkling the upper edge 3 of the foil web 1. At the same time, the second carriage 21 fastened to the second drive element portion 9 rises upwards and at a certain point its upper surface $18^2$ meets the second pin 17 on the slide bar 16 and pushes the slide bar 16 upwards, causing the second crinkling element 15 attached to the slide bar 16 to rise to the upper position, thus crinkling the lower edge 15 of the foil web 1. Detector 24 assumes the 1 state, on the basis of which the control unit 26 stops the motor 10.

When a transition is to be made from the situation of FIG. 1 to the situation of FIGS. 7 and 8 to crinkle the upper edge 4 of the foil web 1 so as to produce the fourth web width $W_4$, the control unit 26 issues a start command to the motor 10, whereupon the motor 10 starts driving the drive element 7 in the second running direction 12, as illustrated in FIGS. 7 and 8. The third detector 24 is disposed in a suitable location such that the second carriage 21 will cause it to assume the 1 state, on the basis of which the control unit 26 stops the motor 10 when the first crinkling element 14 is at a suitable desired position.

The invention is not limited to the embodiment examples described above; instead, many variations are possible within the scope of the inventive concept defined in the claims.

What is claimed is:

1. Crinkling device for a wrapping machine, designed to adjust the width of a foil web to be wrapped around an object between a full first web width ($W_1$) and a substantially narrow reduced second web width ($W_2$), said crinkling device comprising a frame connected to a foil dispenser comprised in the wrapping machine, said foil dispenser carrying a foil web roll of foil web having a longitudinal upper edge and a longitudinal lower edge, a first wheel rotatably mounted on the frame, a second wheel rotatably mounted on the frame at a distance from the first wheel, an endless drive element, which is passed over the first wheel and the second wheel, forming a first drive element portion and a second drive element portion, said portions extending adjacently and parallel to each other between the wheels in the widthwise direction of the foil web, a power means for moving the drive element optionally in a first running direction with the first drive element portion moving upwards and the second drive element portion moving downwards, and in an opposite second running direction with the first drive element portion moving downwards and the second drive element portion moving upwards.

a first carriage, which is fastened to the first drive element portion and guided in the frame so as to be movable in the widthwise direction of the foil web, a first criniding element, which is mounted on the first carriage for crinkling the upper edge of the foil web, a second crinkling element, which is movable by the action of the drive element in the widtbwise direction of the foil web for crinkling the lower edge of the foil web, characterized in that the crinkling device comprises a slide rod, to which the second crinkling element is fastened and which is guided in the frame so as to be movable in a substantially vertical direction between a lower position, in which the second crinkling element is out of contact with the lower edge of the foil web, and an upper position, in which the second crinkling element deflects the lower edge of the foil web upwards so as to crinkle it, said slide rod being arranged to return towards the lower position when not exposed to a force acting in the upward direction;

first coupling means for forming a releasable coupling between the slide rod and the first drive element portion when the drive element is running in the first direction to move the second crinkling element to the upper position; and second coupling means for forming a releasable coupling between the slide rod and the second drive element portion when the drive element is running in the second direction to move the second crinkling element to the upper position;

so that, by driving the drive element in the first running direction, the foil web can only be crinkled from its lower edge, and by driving the drive element in the second running direction, the foil web can be crinkled optionally either from the upper edge without crinkling the lower edge or from the upper edge and the lower edge simultaneously.

2. Crinkling device according to claim 1, characterized in that the first coupling means comprise a first dog connected to the slide rod near the upper end, and a second dog, which is connected to the first carriage and fitted to come into contact with the first dog when the drive element is running in the first direction.

3. Crinkling device according to claim 1, characterized in that the crinkling device comprises a second carriage, which is fastened to the second drive element portion and guided in the frame so as to be movable in the widthwise direction of the foil web.

4. Crinkling device according to claim 3, characterized in that the second coupling means comprise a third dog, which is connected to the slide rod near the upper end, and a fourth dog, which is connected to the second carriage and fitted to come into contact with the third dog when the drive element is running in the second direction.

5. Crinkling device according to claim 1, characterized in that the slide rod comprises a straight rod part mounted in the frame by means of guide elements placed between the first drive element portion and the second drive element portion.

6. Crinkling device according to claim 5, characterized in that the slide rod is so mounted in the frame that the slide rod will be returned to the lower position by the action of gravitation.

7. Crinkling device according to any claim 1, characterized in that a return spring is provided between the slide rod and the frame for returning the slide rod to the lower position.

8. Crinkling device according to claim 1, characterized in that the power means is a motor arranged to drive the first wheel or the second wheel.

9. Crinlking device according to claim 1, characterized in that the crinkling device comprises detectors for detecting the position of the carriages and controlling the power means on that basis to stop the motion of the drive element and to change its running direction.

10. Criniding device according to claim 9, characterized in that the detectors are proximity sensors having a first state and a second state; and that the detectors have been fitted to change their state between the first and second states when the first carriage and/or the second carriage is within the detection distance of the detector.

* * * * *